United States Patent [19]

Sadow

[11] Patent Number: 4,685,546

[45] Date of Patent: Aug. 11, 1987

[54] AUXILIARY CARRYING CASE FOR LUGGAGE

[76] Inventor: Brian D. Sadow, 21 Pondhill Rd., Chappaqua, N.Y. 10514

[21] Appl. No.: 892,510

[22] Filed: Aug. 1, 1986

[51] Int. Cl.[4] ..... A45C 3/00; A45C 13/00

[52] U.S. Cl. ..... 190/102; 190/103; 190/108; 190/124; 150/111; 383/10; 383/37; 383/39; 383/907

[58] Field of Search ..... 190/102, 103, 108, 124, 190/900; 383/10, 120, 907, 2, 37, 39, 41; 150/111, 127

[56] References Cited

U.S. PATENT DOCUMENTS

| | | | |
|---|---|---|---|
| 2,170,379 | 8/1939 | Ortt | 383/907 X |
| 2,171,718 | 9/1939 | Vogt | 383/120 X |
| 2,319,729 | 5/1943 | Ford | 190/102 |
| 2,813,602 | 11/1957 | MacArthur, Jr. | 190/108 X |
| 3,227,338 | 1/1966 | Hall | 383/907 X |

FOREIGN PATENT DOCUMENTS

| | | | |
|---|---|---|---|
| 1458044 | 12/1976 | United Kingdom | 190/102 |

*Primary Examiner*—William Price
*Assistant Examiner*—Sue A. Weaver
*Attorney, Agent, or Firm*—Abelman Frayne Rezac & Schwab

[57] ABSTRACT

An auxiliary carrying case is provided with an apertured upper extension of a rear wall thereof which can be bent over and placed over the handle of a conventional carrying case for the auxiliary case to be carried piggy back on the conventional carrying case.

3 Claims, 6 Drawing Figures

FIG. 1
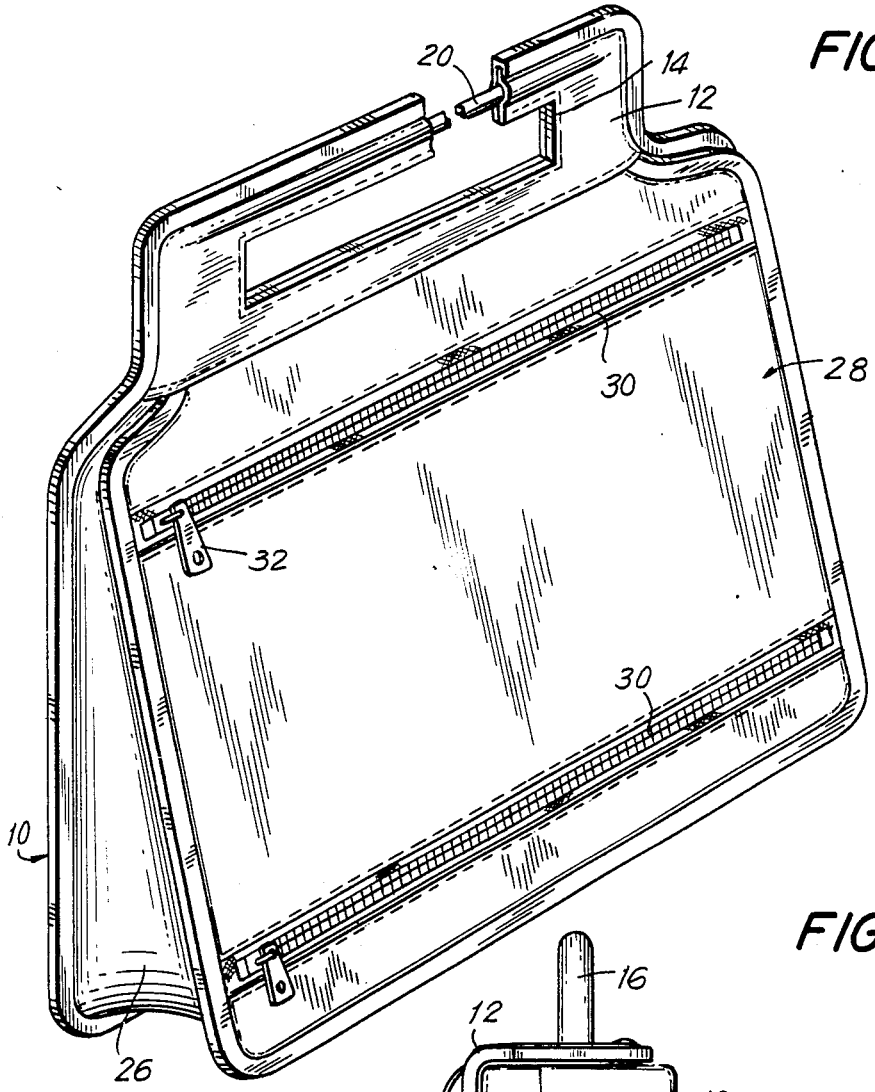
FIG. 4
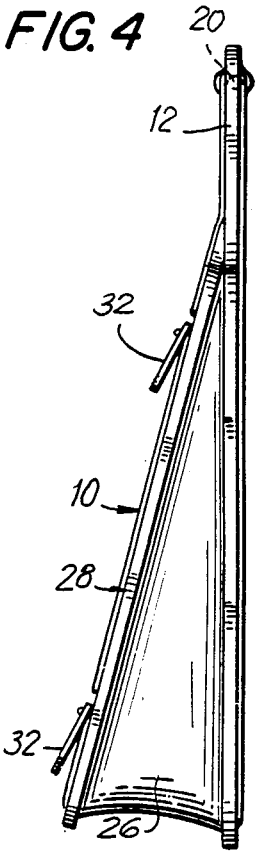
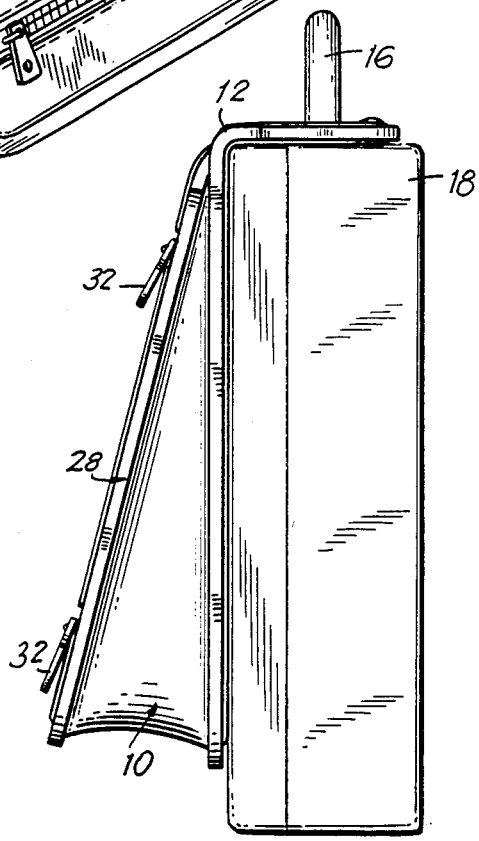
FIG. 3

AUXILIARY CARRYING CASE FOR LUGGAGE

FIELD OF THE INVENTION

This invention relates to articles of luggage in general, and more particularly relates to an auxiliary carrying case to be used either alone, or, in combination with a conventional article of luggage having a centrally disposed carrying handle.

BACKGROUND OF THE INVENTION

Commonly known articles of the luggage are in the form of suit cases, brief cases, and the like, which have a centrally disposed carrying handle on the upper surface thereof.

The occasion frequently arises that a user of such a case finds it necessary to carry an additional such case, such as a portfolio, an overnighter bag or the like.

This requires that the user employ both hands for carrying the separate articles of luggage, or, and usually most inconveniently, the user must carry both articles of luggage in a single hand.

SUMMARY OF THE INVENTION

It is an object of this invention to provide an auxiliary article of luggage, that either can be used as a separate article of luggage, or, which can be detachably attached to a conventional suit case, brief case, or the like to provide a unitized composite of the two articles of luggage.

In order to accomplish this object, the auxiliary carrying case of the present invention is provided with a rectangular substantially planar rear wall which is formed from a flexible material.

An elongate, substantially rectangular, upward continuation of the rear wall is provided either integrally with the rear wall, or, as an attachment secured to the upper edge of the rear wall.

The upward continuation is provided with an elongate aperture of a size in excess of the width and length of a conventional carrying handle of an article of luggage, such that the upward continuation can be slipped over the conventional carrying handle, and so be detachably attached to the conventional article of luggage.

In order to absorb the loading imposed on the rear wall, which constitutes the major structural element of the auxiliary case, a metal or other reinforcing rod is incorporated into the upward extension, and extends along the side of the aperture remote from the rear wall.

Optionally, and preferably, the upward extension is of sandwich construction, the peripheral edges of front and rear walls comprising the upward continuation being secured to each other peripherally of their edges, and peripherally of the elongate aperture. In this manner, the reinforcing rod is concealed within the upward continuation, and presents an esthetically pleasing appearance.

Attached to the rear wall is any desired organization of pouches or pockets, each of which is provided with an access opening that is closed by a suitable means, such as by a zipper.

In use, articles to be carried are inserted into the pouches in an entirely conventional manner, the rear wall remaining substantially planar. The user then can grasp the auxiliary carrying case by its own carrying handle comprised by the reinforcing rod, and, if desired, can carry the auxiliary carrying case as a separate item of luggage. If this is inconvenient, then, upward extension is folded through approximately 90 degrees, and is slipped over the handle of a conventional carrying case, the handle of the carrying case then protruding upwardly through the aperture in the auxiliary carrying case.

At this time, the reinforcing rod acts to distribute the load imposed on the rear wall, and to transmit that load to the conventional carrying handle in a direction laterally of the conventional carrying handle.

The user can then grasp the handle of the conventional article of luggage and lift carry both articles of luggage using but a single hand.

DESCRIPTION OF THE DRAWINGS

The invention will now be described with reference to the accompanying drawings, in which;

FIG. 1 is a front perspective view of the auxiliary carrying case of the present invention;

FIG. 3 is an end elevation of a conventional carrying case with the auxiliary carrying case of the present invention attached thereto in piggy back fashion.

FIG. 4 is a side elevation of the auxiliary carrying case, the opposite side being a mirror image of FIG. 4;

DESCRIPTION OF THE PREFERRED EMBODIMENT

Figure 2:
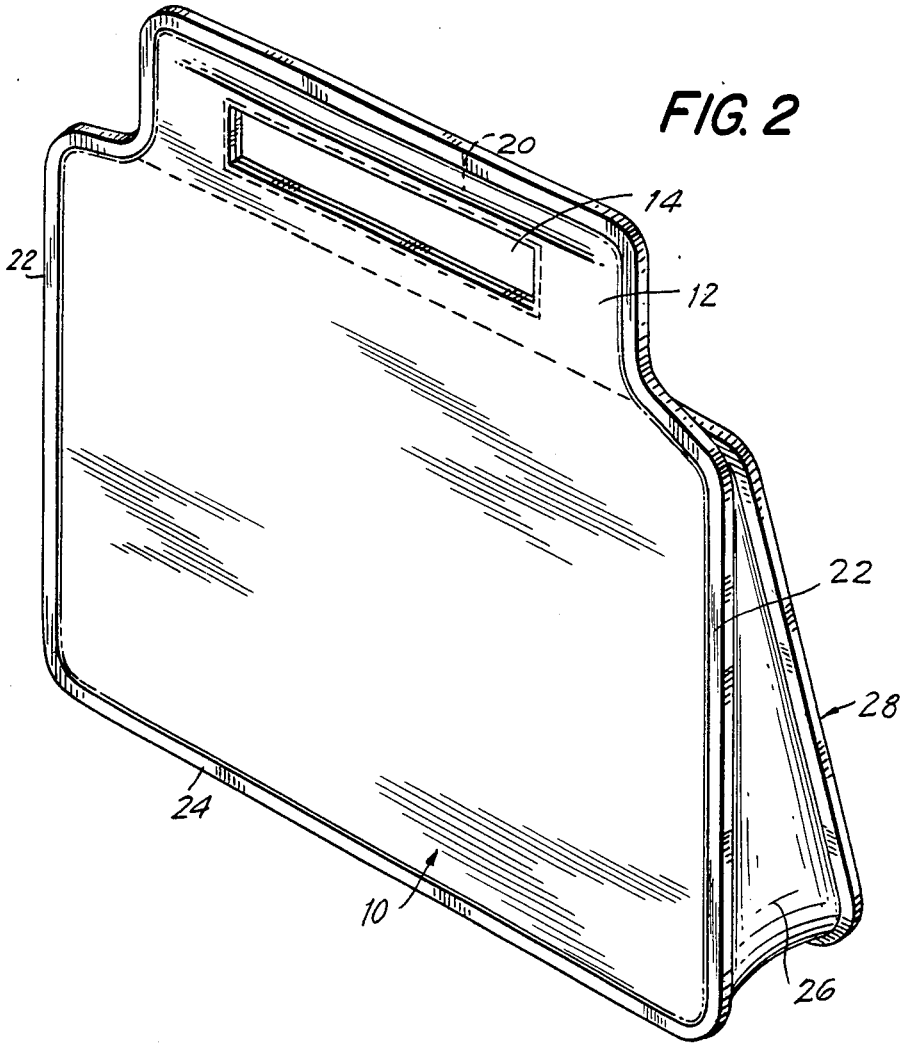
FIG. 2 is a rear perspective view of the auxiliary carrying case.
Figure 5:
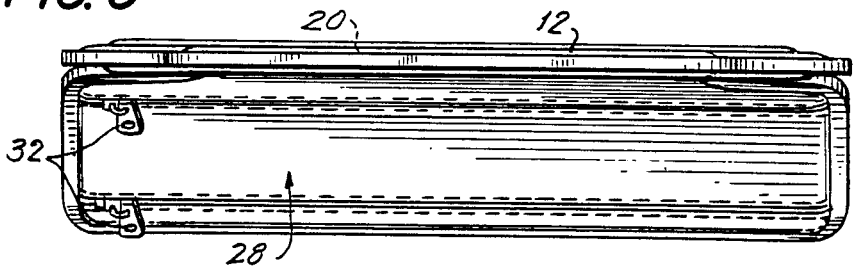
FIG. 5 is a top view of the auxiliary carrying case.
Figure 6:
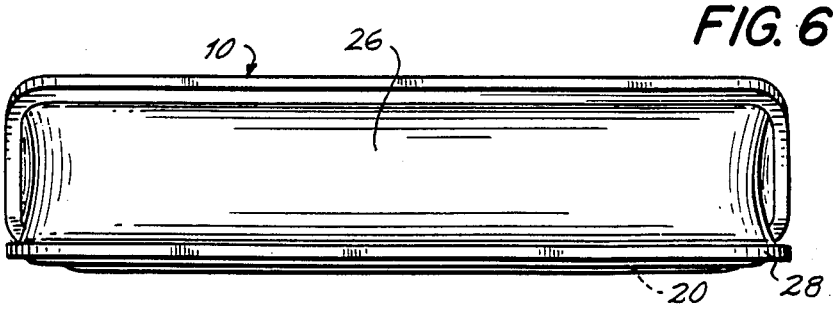
FIG. 6 is an underside view of the auxiliary carrying case.

Referring now to FIGS. 1 and 2, the auxiliary carrying case has a substantially planar rear wall 10, preferably formed from a relatively stiff but flexible material. A sturdy cloth of woven synthetic plastic monofiliments is preferred, coated on one side with a water proofing material, such as latex.

The rear wall 10 is substantially rectangular, and, at its upper edge either is attached to an upward continuation 12 of the rear wall, or, the upward continuation is an integral extension of the rear wall.

Positioned centrally of the upward extension 12 is an elongate aperture 14, the aperture being of a length and width sufficient for the upward extension 12 to be positioned over the handle 16 of a conventional carrying case 18 as shown in FIG. 3.

Positioned immediately adjacent the elongate aperture 14 is an elongate reinforcing rod 20, that provides either a carrying handle in the event that the auxiliary carrying case used separately from the article of luggage 18, and which acts to distribute the loads imposed on the rear wall 10 either when the auxiliary carrying case is used independently, or, when it is attached to a conventional carrying case 18 in piggy back fashion.

Preferably, the upward extension 12 is formed formed from two separate pieces of material which are secured to each other around their external periphery and around the periphery of the aperture, and which house and conceal the reinforcing rod 20. Further, the double thickness of material and the attachment of the respective layers to each other acts to stiffen the upward continuation and make it less pliable than the rear wall 10.

Attached to the side edges 22 and the bottom edge 24 of the rear wall 10 are gussets 26, which provide a connection between the rear wall 10 and a front wall 28. The front wall can be of a material identical with that of the rear wall, and is provided with a suitable access openings 30 which conveniently are closable by zippers 32.

As illustrated in FIG. 1, the front wall 28 is attached directly to the rear wall 10 along its upper edge. If desired, a further gusset can be provided at this location to provide substantially parallel spacing of the front wall 28 from the rear wall 10, instead of the respective walls be arranged in wedge formation as illustrated in the drawings.

Conveniently, bias binding is provided along the edges of the front and rear walls and at the edges of the upward continuation 12, which is applied in any conventional manner, such as by stitching, ultrasonic welding or dielectric welding.

While zippers 32 has been shown as convenient closures for the access openings 30 in the front wall 28, it will be readily appreciated that button down flaps or other such conventional structures can be substituted therefor.

It will be understood that various modifications in the structures described can be made within the scope of the appended claims, the structure illustrated being but one of the preferred embodiment. For example, instead of providing a single front wall 28 attached to the rear wall 10, a plurality of separate pouches can be attached to the rear wall 10. Further, additional members may be provided on the front wall 28, such as straps, or loops for the support of an umbrella. Further, the interior cavity of the auxiliary carrying case can be arranged in any desired manner, for example, the lowermost access opening 30 can be an access opening to a separate compartment for toiletries, the walls of which are formed from a waterproof material, such as sheet vinyl.

I claim:

1. An auxiliary carrying case, comprising:

a substantially rectangular planar rear wall formed from a flexible material;

an elongate substantially rectangular upward continuation of said rear wall having an elongate aperture of a size in excess of the width and length of a conventional carrying handle of an article of luggage;

a reinforcing rod affixed to said upward continuation and extending longitudinally thereof at that side of said elongate aperture that is remote from said rear wall, said reinforcing rod being of an axial length at least equal to the length of said aperture; and, pouch means attached to a front face of said rear wall, said rear wall providing the sole support for said pouch means, and including a front wall substantially coextensive with said rear wall, and which is connected to said rear wall by gussets along three of its edges, the fourth edge of said wall being connected directly to said rear wall and to said upward continuation further including access openings in said front wall, and closure means for said access openings.

2. The auxiliary carrying case of claim 1, in which said reinforcing rod is sandwiched between and concealed within dual said upward continuations, said dual upward continuations being secured to each about their periphery and about the periphery of said aperture to hold said reinforcing rod captive within the composite said upward continuation.

3. The auxiliary carrying case of claim 2, in which one of said upward continuations is integral with said rear wall.

* * * * *